United States Patent [19]

Smith

[11] 4,068,576

[45] Jan. 17, 1978

[54] HAND-OPERATED PRESS FOR BALING NEWSPAPERS

[76] Inventor: Richard K. Smith, 12096 Ventura Avenue, Ojai, Calif. 93023

[21] Appl. No.: 750,538

[22] Filed: Dec. 14, 1976

[51] Int. Cl.[2] ..... B30B 1/12

[52] U.S. Cl. ..... 100/219; 100/3; 100/233; 100/240; 100/286

[58] Field of Search ..... 100/219, 3, 34, 240, 100/233, 280, 281, 286, 283, 285, 293

[56] References Cited

U.S. PATENT DOCUMENTS

| | | | |
|---|---|---|---|
| 26,546 | 12/1859 | Chichester | 100/288 |
| 383,033 | 5/1888 | Bartle | 100/286 |
| 2,423,209 | 7/1947 | Storey | 100/293 |
| 3,728,959 | 4/1973 | Fredrickson | 100/3 |

*Primary Examiner*—Billy J. Wilhite
*Attorney, Agent, or Firm*—Keith D. Beecher

[57] ABSTRACT

A manually-operated press is provided in which old newspapers in a folded condition may be stacked, pressed into a compact bundle, and then bound into a bale, by appropriate metal binding straps, or the like, and then sold to waste paper collectors. The press comprises a compression box having a fixed bottom and a movable top, and it also has an open front through which newspapers may be stacked in the compression box. A lever-like handle is coupled to the moveable top of the compression box through a linkage system. The mechanical advantage of the linkage system is a function of the handle angle, and is non-linear. At the beginning of the downward stroke of the handle, the mechanical advantage of the linkage is a minimum and is just sufficient to cause the air to be squeezed out of the stack of newspapers placed in the compression box as the handle is lowered. As the handle is further lowered, the mechanical advantage of the linkage system increases as the linkage arms of the system turn and approach the vertical position. A stop is provided just past dead center of the linkage system, at which position the top of the compression box locks the bale of newspapers in the compression box under pressure. Slots are provided in the top and bottom of the compression box to facilitate strapping of the bale. After strapping, the handle is lifted and the bale is removed. A small latch pin holds the press open for loading purposes.

7 Claims, 7 Drawing Figures

HAND-OPERATED PRESS FOR BALING NEWSPAPERS

BACKGROUND OF THE INVENTION

The invention is primarily concerned with the provision of the manually-operated mechanical press which is useful in forming and compressing a stack of old newspapers, and for locking the stack under pressure in preparation for strapping the stack into a bale. The press of the invention is advantageous in that it is relatively simple and economical to construct, it is simple to operate, and it can conveniently be carried from place-to-place.

The press is capable of forming a tight bale of newspapers of uniform dimensions and weight. The precision of the dimensions of the bale results from the geometry of the press itself. The press includes a compression box having a movable top which closes to a fixed height under any pressure, if it closes at all. Therefore, a predetermined amount of newspapers must be inserted into the compression box, in order for the press to close and lock. In this way, it is possible for the press to produce bales of uniform weight, without the use of scales.

The press of the invention is manually-operated and the lever action provided by the handle in the embodiment to be described is such that a 100 pound child can exert a force of approximately 1 ton on a stack of newspapers in the compression box, simply by applying his own weight. Since the press uses no electricity or other power source, it can be used anywhere.

The embodiment to be described is made from wood and simple hardware items. It is uncomplicated in its design, and it can be economically and quickly manufactured. The press of the invention is sufficiently heavy and rugged in its construction to withstand rough usage, but is light enough to be wheeled around in a hand truck.

DETAILED DESCRIPTION OF THE DRAWINGS

Figure 1:
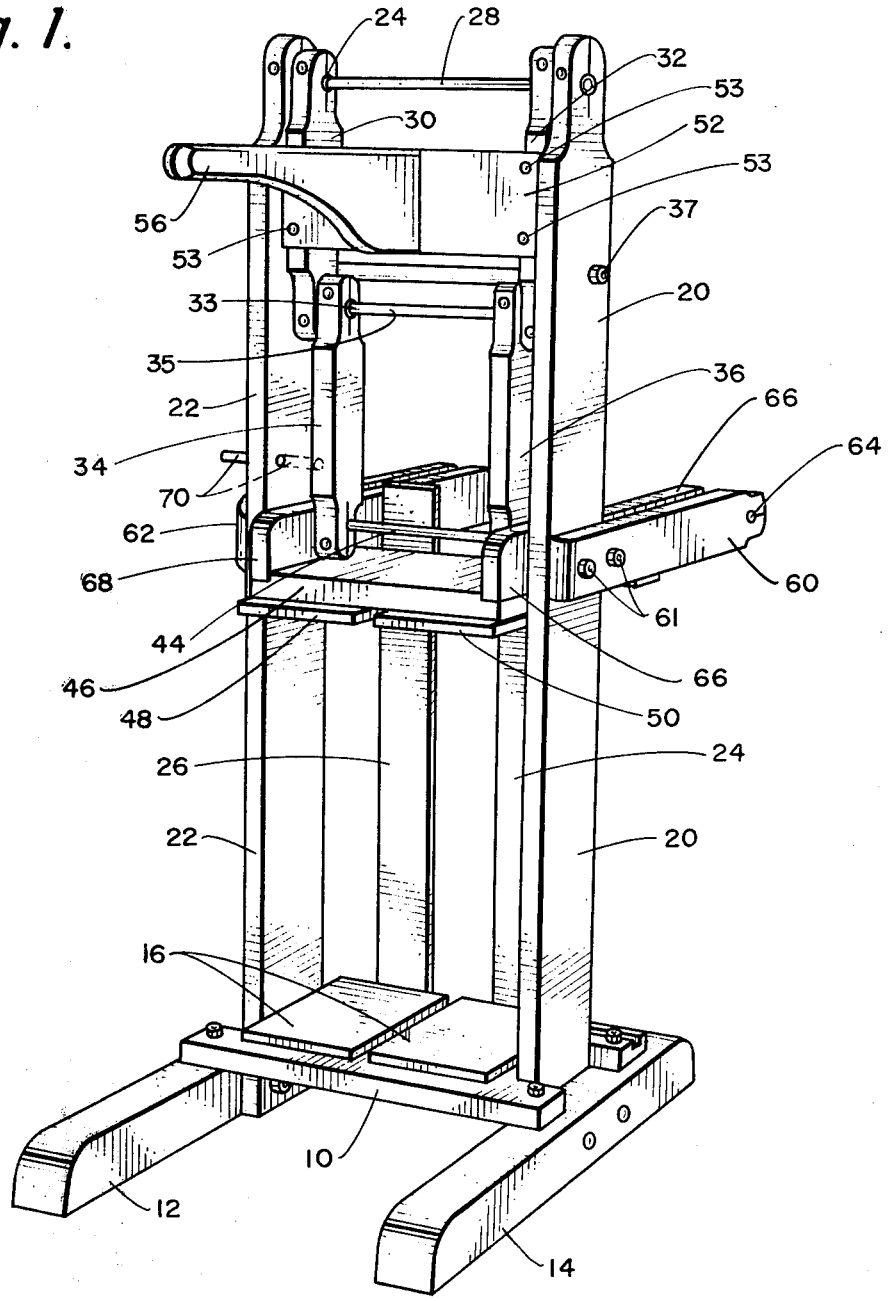
FIG. 1 is a perspective view of one embodiment of the invention.
Figure 7:
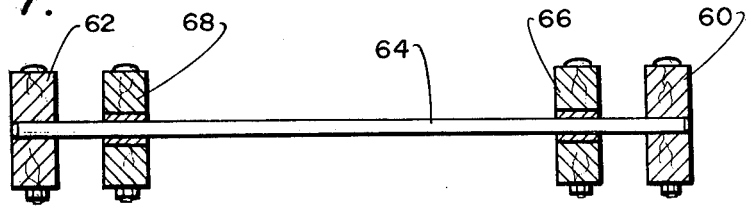
FIGS. 6 and 7 are sections taken along the lines 6—6 and 7—7 respectively, of FIG. 5.

The press shown in the drawings includes a base 10 which is supported on a pair of skids 12 and 14. A bottom 16 for a compression box is mounted on the base 10. The bottom has an intermediate channel extending from one end to the other to facilitate strapping of the stack of newspapers which are supported on the bottom when the press is operated.

The press includes a frame formed of a pair of upright elongated side members 20 and 22, which are mounted on the base 10. A pair of elongated upright rear members 24 and 26 also extend upwardly from the base to form a back for a compression box. The front of the compression box is open so as to permit a stack of newspapers to be placed within the compression box.

Figure 6:
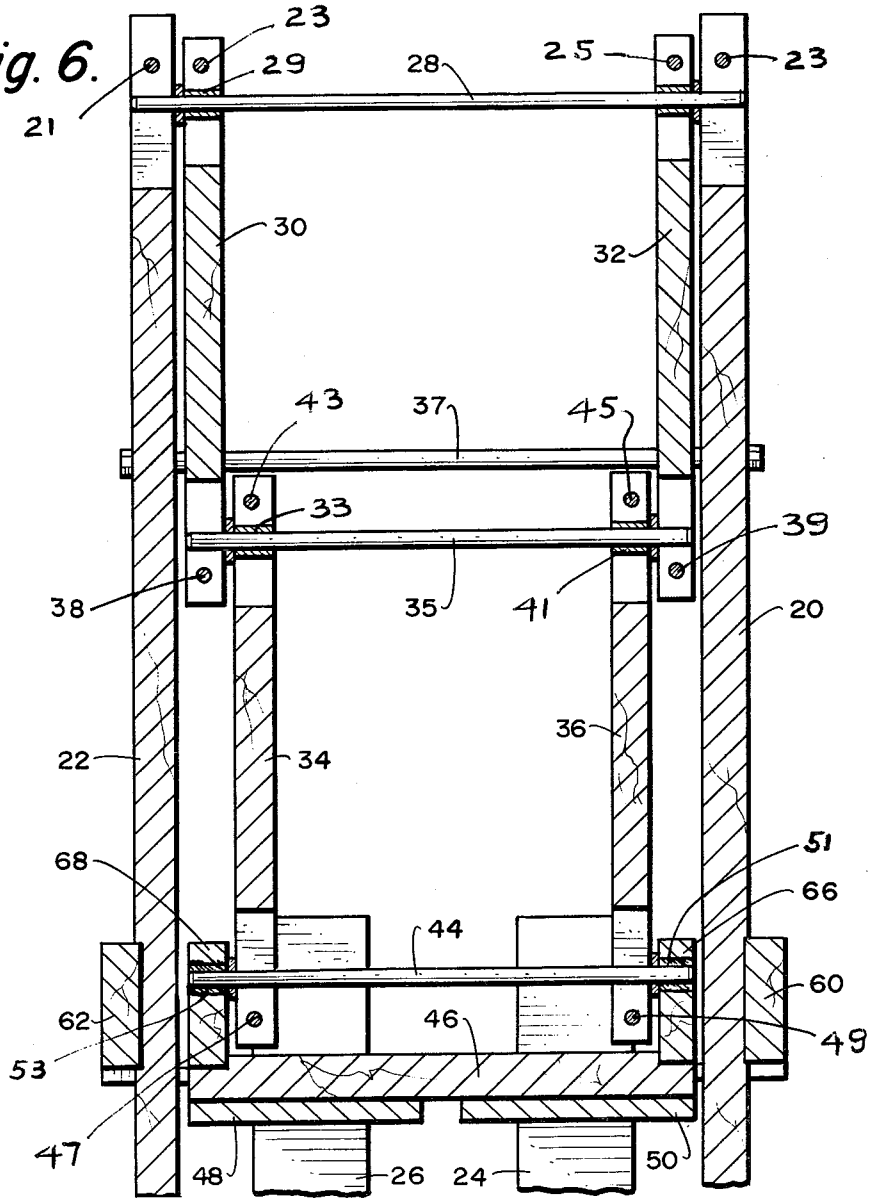
Figure 5:
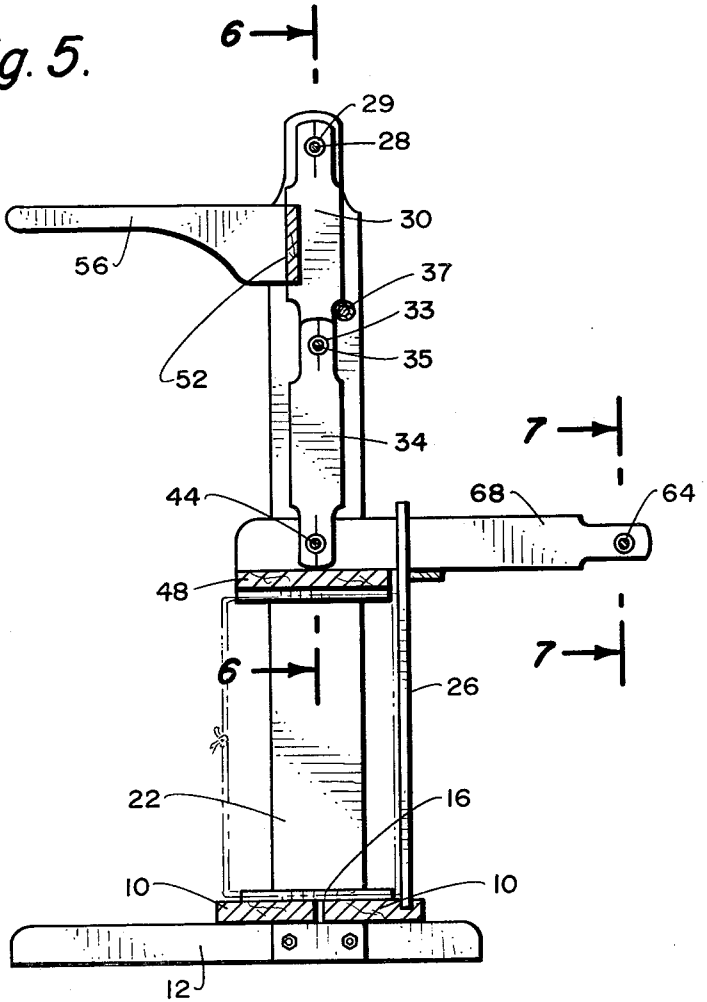
FIG. 5 is a side section similar to FIG. 4.

A first transverse rod 28 extends between the upper ends of the upright members 20 and 22, and is locked in place by bolts 21 and 23 (FIG. 6). A first pair of linkage arms 30 and 32 are pivotally mounted to transverse rod 28 in bushings 29 and 31 which are locked in place by bolts 23 and 25. A second transverse rod 35 is attached to and extends across the lower ends of arms 30 and 32, and is locked in place by bolts 38 and 39. A second pair of linkage arms 34 and 36 have their upper ends pivotally coupled to the rod 35 in bushings 33 and 41 which are locked in place by bolts 43 and 45. The lower ends of arms 34 and 36 are attached to a third transverse rod 44 and are locked in place by bolts 47 and 49.

A rectangular shaped member 46, and a pair of flat members 48 and 50 formed of appropriate composition and mounted to the underside of the member 46, constitute a movable top for the aforesaid compression box. A central channel is provided in the movable top to facilitate strapping of the bale of newspapers formed in the press of the invention.

A further elongated member 52 extends transversely across the arms 30 and 32, and is secured thereto by appropriate bolts 53. As lever-like handle 56 is turned, the linkage arms 30 and 32 turn about the rod 28, and the linkage arms 34 and 36 turn about the rod 35 and turn the rod 44 to move the top 48, 50 up and down in the compression box.

Figures 2, 3, 4:
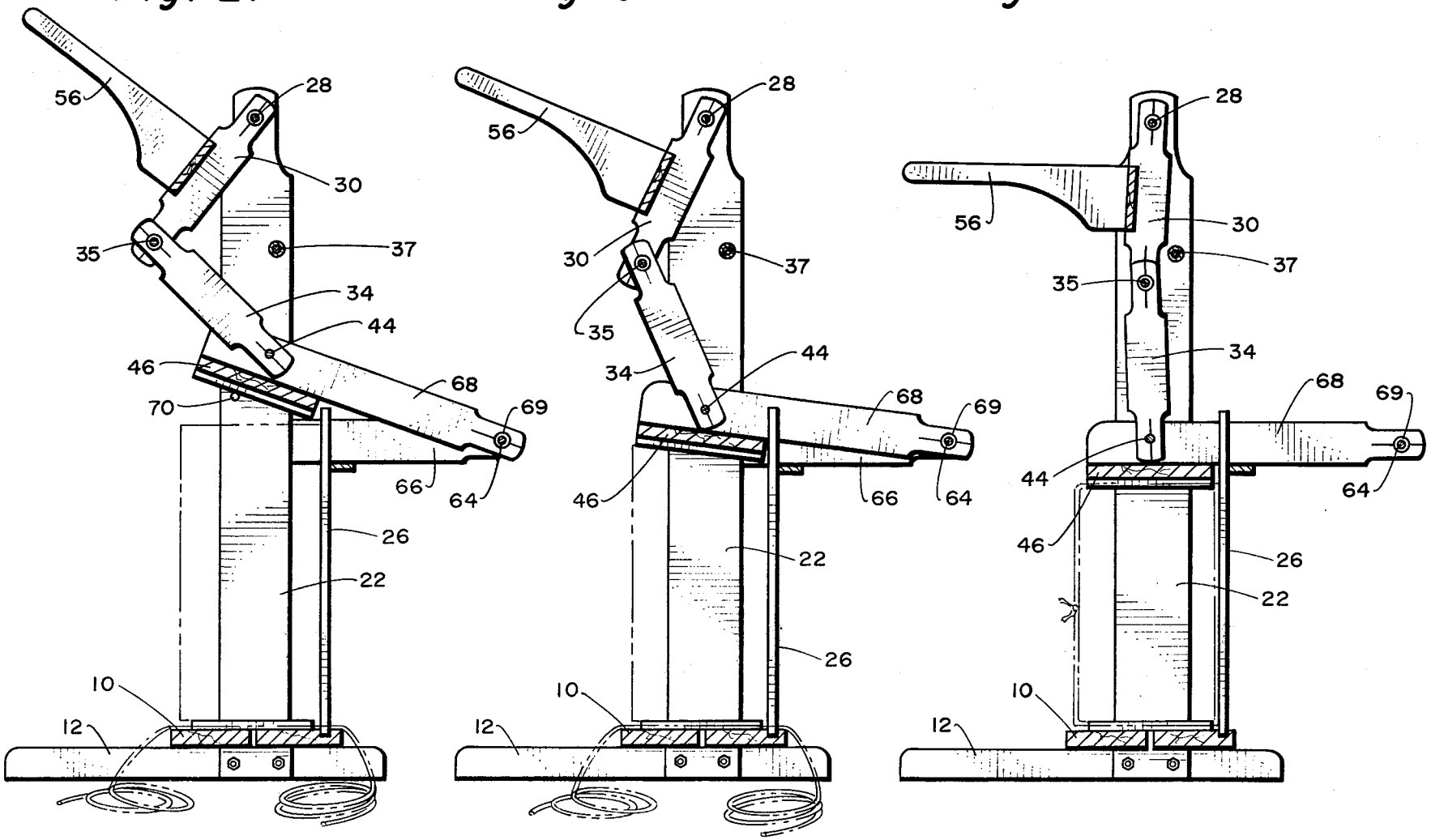
FIGS. 2, 3 and 4 are side sections of the embodiment of FIG. 1, showing the press in different operating positions.

For example, as the handle 56 is turned to an upper position, the linkage arms 30 and 32 assume an angular relationship with the linkage arms 34 and 36, such as shown in FIG. 2. However, when the handle is turned down through an intermediate position (FIG. 3) to a lower position (FIG. 4), the linkage arms 30 and 32 and the linkage arms 34 and 36 assume a coplanar generally vertical position. A stop means, in the form of a transverse rod 37 between the upright side members 20, 22 is provided to stop any further rotation of the linkage arms, as the handle 56 is moved downwardly to the position of FIG. 4, and as the arms 30, 32 and 34, 36 move just past their dead-center vertical position. This provides an over-center means for locking the press when the handle is in the down position, so as to hold the bale of newspapers in the compression box in a compressed state, until appropriate straps may be wound about the stack of newspapers through the channels provided in the top and bottom of the compression box.

A pair of elongated arms 60, 62 extend generally horizontally outwardly from the upright member 20, 22 the arms 60 and 62 being secured to the upright members by appropriate bolts such as bolts 61 (FIG. 1). A transverse rod 64 is attached to and extends between the distal ends of the arms 60 and 62. A further pair of arms 66 and 68 are secured to each end of the member 46, and are pivotally mounted at one end of the rod 64 by bushings such as bushings 69. The arms 66 and 68 are also pivotally coupled to rod 44 by bushings 51 and 53, which are locked in place by appropriate bolts. The arms 66, 68 and 60, 62 cause the member 46 and movable top of the compression box to be moved pivotally about the axis of rod 64 as the handle 56 is turned between its upper position (FIG. 2) and its lower position (FIG. 4). A small latch pin 70 serves to hold the press in its open position (FIG. 2) with the top of the compression box displaced up from the bottom 16 for loading purposes.

As described above, when the handle 56 is turned down from its upper position of FIG. 2, the mechanical advantage of the linkage system is a non-linear function of the handle action, and at the beginning of the downward stroke of the handle, the mechanical advantage of the linkage is a minimum, and is just sufficient to cause the top of the compression box to squeeze the air out of the stack of newspapers placed in the compression box. As the handle is further lowered to the position of FIG. 3, the mechanical advantage of the linkage system increases, as the linkage systems turns and approaches its vertical position of FIG. 4. The stop means 37 which is provided just past dead-center of the linkage system, as shown in FIG. 4 and as explained above, provides an over-center lock for the system and causes the top of the compression box to lock the resulting bale of newspapers in the compression box under pressure. The bale may then be strapped, and after strapping, the handle is lifted and the bale is removed.

While a particular embodiment of the invention has been shown and described, modifications may be made. It is intended in the claims to cover the modifications which come within the spirit and scope of the invention.

What is claimed is:

1. A manually-operated press for compressing a stack of folded newspapers, and the like, comprising: a base forming the bottom of a compression box; a frame mounted on the base and forming the sides and back of the compression box and defining an open front for the compression box, said frame including a pair of spaced and parallel elongated upright members and a first pair of spaced and parallel generally horizontal elongated members extending outwardly from intermediate positions on respective ones of the upright members; a first pair of spaced and parallel linkage arms; means for pivotally mounting the linkage arms of the first pair to the top of the frame; a second pair of spaced and parallel linkage arms pivotally mounted to the lower ends of the respective arms of the first pair; a top for the compression box pivotally mounted to the lower ends of the second pair; a second pair of elongated parallel members attached to said top and extending outwardly therefrom in generally co-planar relationship therewith; means pivotally coupling the distal ends of said generally horizontal elongated members of said first pair and the distal ends of said elongated members of said second pair; and a lever-like handle affixed to one of the pairs of parallel linkage arms and extending outwardly from the plane thereof for turning the parallel linkage arms between an inclined position and an essentially vertical position so as to move said top up and down in said compression box.

2. The manually-operated press defined in claim 1, in which said lever-like handle is affixed to the first pair of arms.

3. The manually-operated press defined in claim 2, and which includes a second rod extending transversely between the lower ends of the arms of the first pair, and between the upper ends of the arms of the second pair, for pivotally mounting the arms of the second pair to the arms of the first pair.

4. The manually-operated press defined in claim 3, and which includes a third rod extending between the lower ends of the arms of the second pair for pivotally mounting said top to the lower ends of the arms of the second pair.

5. The manually-operated press defined in claim 2, and which includes stop means for preventing further angular movement of the linkage arms when the linkage arms move past their essentially vertical position as said handle is moved to a lower position so as to lock the top of the compression box at a predetermined height above the bottom thereof.

6. The manually-operated press defined in claim 1, in which the base, the frame, the linkage arms, the top and the handle are all formed of wood.

7. The manually-operated press defined in claim 1, in which said last-named pivotally coupling means comprises a rod extending across the distal ends of said generally horizontal elongated members of the first-named pair and across the distal ends of said elongated members of the second pair.

* * * * *